United States Patent [19]

Young

[11] 3,946,272

[45]*Mar. 23, 1976

[54] LOW POWER SEALED OPTICALLY THIN RESONANCE LAMP

[76] Inventor: Robert A. Young, R.R. No. 2, Loretto, Ontario, Canada

[ * ] Notice: The portion of the term of this patent subsequent to Mar. 26, 1991, has been disclaimed.

[22] Filed: Oct. 7, 1974

[21] Appl. No.: 512,976

Related U.S. Application Data

[63] Continuation-in-part of Ser. No. 426,616, Dec. 12, 1973, Pat. No. 3,851,214.

[52] U.S. Cl. ..... 315/267; 313/110; 313/180; 313/201; 313/220; 313/224; 315/344

[51] Int. Cl.[2] ..... H05B 41/24

[58] Field of Search ..... 313/110, 174, 180, 201, 313/214, 217, 220, 224, 234; 315/108–110, 248, 267, 283–286, 344; 331/77

[56] References Cited

UNITED STATES PATENTS

| | | | |
|---|---|---|---|
| 2,664,510 | 12/1953 | Russo | 331/77 |
| 2,740,911 | 4/1956 | Doolittle | 313/220 X |
| 2,776,373 | 1/1957 | Mischler | 331/77 X |
| 3,493,805 | 2/1970 | Bass | 313/220 X |
| 3,851,214 | 11/1974 | Young | 313/110 X |

*Primary Examiner*—Paul L. Gensler
*Attorney, Agent, or Firm*—John E. Benoit

[57] ABSTRACT

A resonance lamp having a controllable chemical decomposition source of a parent species and a chemical getter sink in a sealed RF excited discharge. The discharge occurs in a second, extremely pure gas which is present in great excess over the gas produced by chemical decomposition. Excitation of species whose emission is desired occurs by electron impact or energy transfer from the major species which are, in turn, excited by the electron impact.

7 Claims, 6 Drawing Figures

FIG. 3
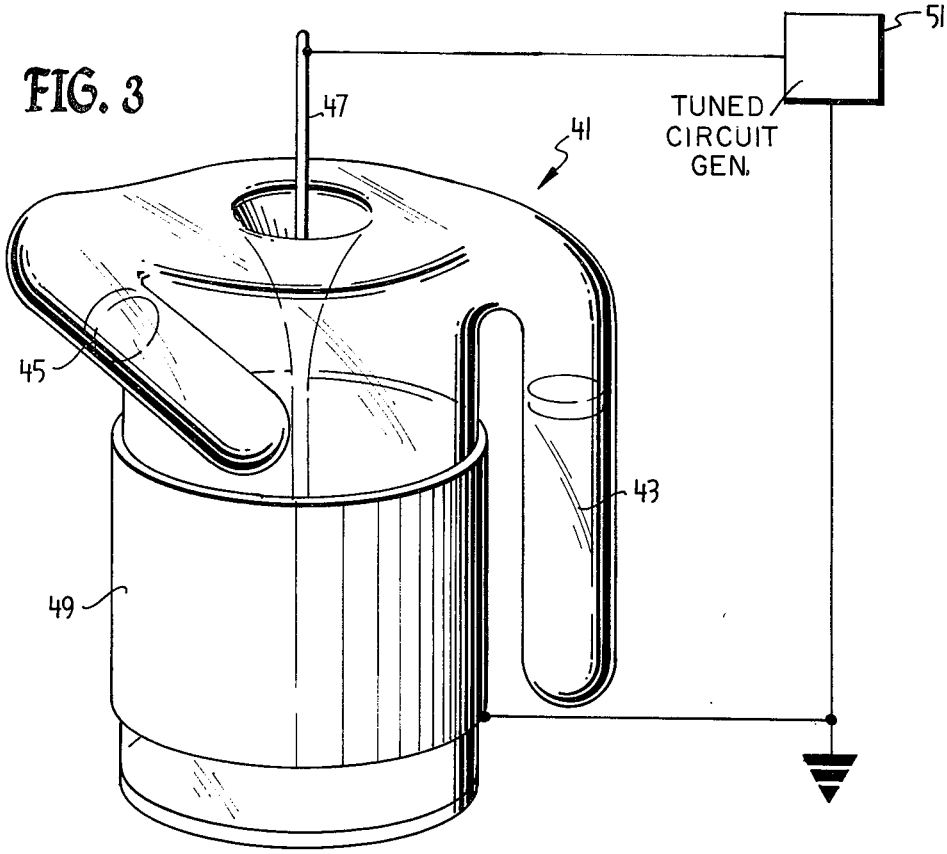
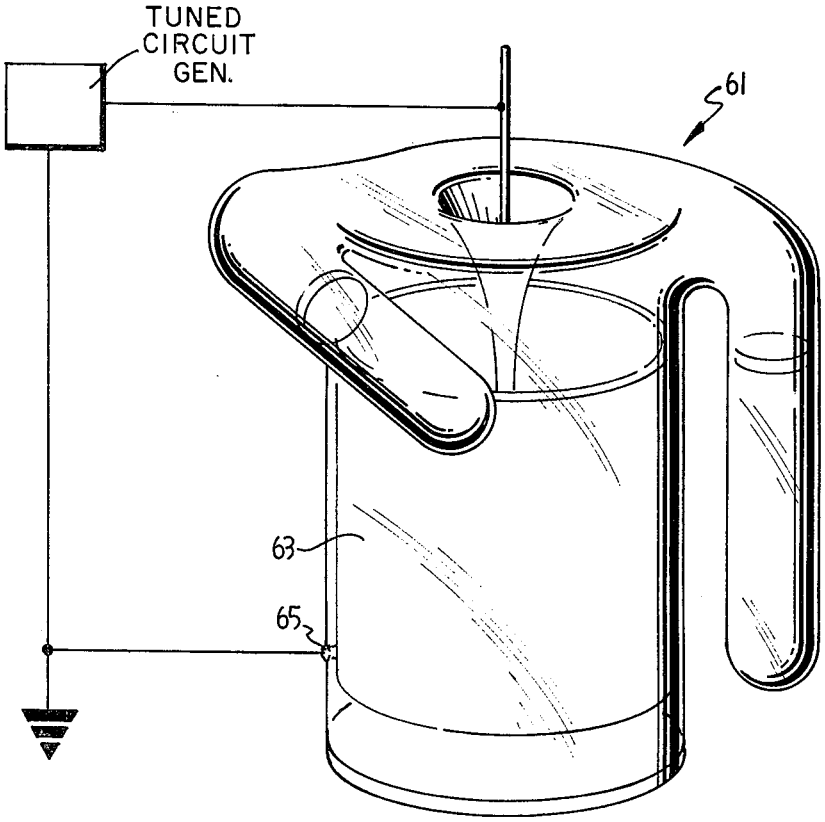
FIG. 4

LOW POWER SEALED OPTICALLY THIN RESONANCE LAMP

This application is a Continuation-In-Part of U.S. application Ser. No. 426,616, now U.S. Pat. No. 3,851,214, filed Dec. 12, 1973, in the name of the present inventor.

This invention relates generally to resonance lamps and more particularly to self-breakdown gas discharge lamps suitable for excitation by low power, low voltage, radio frequency power.

The use of resonance absorption and fluorescence is becoming more important in the field of chemical kenetic research.

Most lamps used to produce resonance radiation of atoms derived from gaseous compounds utilize an AC electrical discharge in a low pressure gas which flows away from the emission direction. Since dissociation must coincide or precede excitation, it is difficult to obtain bright resonance lamps without absorption within the lamp. Such absorption decreases the sensitivity of measuring devices using resonance lamps, and introduces complications in relating intensity measurements to the concentration of absorbers.

Although non-flowing, sealed resonance lamps have considerable convenience, they are difficult to control since the discharge interacts with the walls of the lamp to either remove or provide constituents. This is particularly true for oxygen.

Accordingly, it is an object of this invention to provide a very intense resonance lamp which emits radiation such that direct detection of the transmitted or scattered radiation, without the intervention of filters of dispersal devices, can be used to measure the concentration of the absorbing species, while preserving a Doppler line profile unmodified by absorption within the lamp.

These and other objects of the invention will become apparent from the following description when taken in conjunction with the drawings wherein FIG. 1 is a schematic diagram of the tube of the present invention;

FIGS. 3 and 4 are perspective views of modified embodiments of the present invention.

Broadly speaking, the present invention utilizes a controllable chemical decomposition source of parent species and a chemical getter sink in a sealed RF excited discharge. This discharge occurs in a second, extremely pure gas which is present in great excess over the gas produced by chemical decomposition. Excitation of species whose emission is desired occurs by electron impact or energy transfer from the major species which are, in turn, excited by the electron impact.

Figure 1:
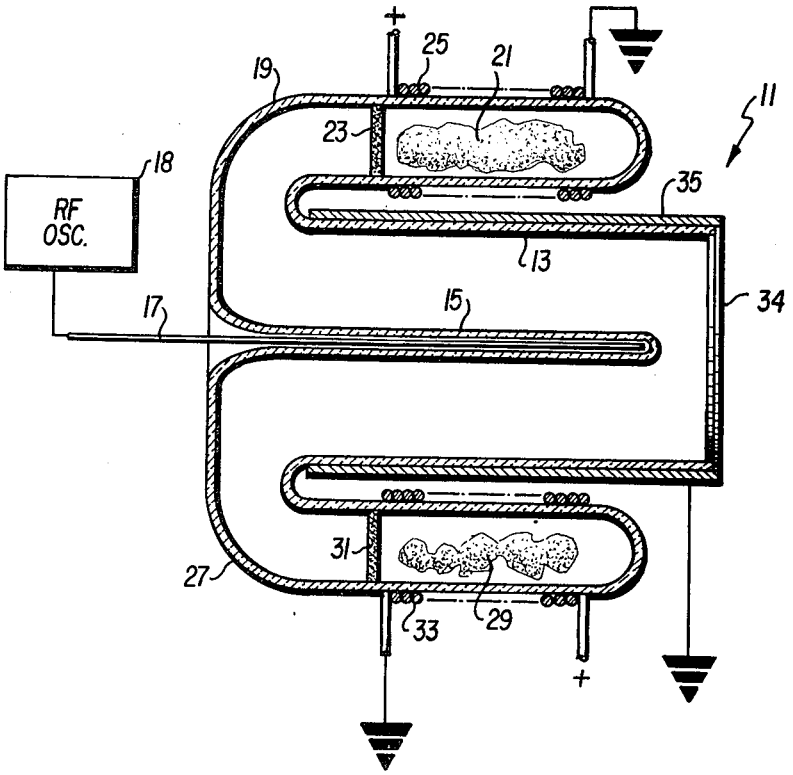

Illustrated in FIG. 1 is a cylindrical body 11 having a glass wall 13 and a hollow reentrant element 15. Reentrant element 15 extends coaxially substantially the length of the cylinder. An electrical conductor 17 is contained within the hollow reentrant element and extends outwardly to connect to an RF energy source 18.

A first hollow arm 19 is integral with cylinder 11 and extends outwardly therefrom. The arm is closed at the outer end and is filled with a getter or scavenger 21 such as uranium or a barium containing compound. A gas permeable barrier 23, such as a glass frit, in hollow arm 19 prevents the getter from moving into the cylinder. Heating means 25 here illustrated as an electrical heater, is provided about the arm so as to heat the getter material if necessary.

A second arm 27 also extends from the cylinder and is closed at its outer end. This arm contains the source 29 of the species whose emission is desired. A barrier 31 and a heater 33 are also provided on arm 27.

Cylindrical body 11 is closed at the other end by a window 34 which is transparent to the spectral emission of the species being examined. A special epoxy cement may be required to attach the window to the body of the lamp.

In order to complete the necessary path for electrical excitation, the outside of cylinder 11 may be coated with an electrically conductive material 35 and this coating is grounded as shown. If the cylinder is largely contained within a close fitting, grounded conducting enclosure, a separate coating is not required. In either case, the cylinder is effectively sheathed by a conductive element.

The lamp of the present invention may be used to produce emission of a number of desired species. Examples of such use are shown below.

OXYGEN RESONANCE LAMPS

The lamp is subjected to the usual vacuum pump down procedures and the lamp is filled with approximately 1–2 torr of He. One arm of the lamp is provided with a getter such as Ur. The other arm is supplied with an oxygen source such as $MnO_2$ or $KMnO_4$.

For operation of the lamp, high purity is essential. The reason for this is believed to be due to the role of He* (metastable, excited) which builds up in the discharge to a high concentration in the absence of $O_2$ from the source. With the application of heat to the decomposition source, $O_2$ is added and the following reaction takes place in the presence of RF excitation at 150 to 600 megahertz.

| | |
|---|---|
| $He^* + O_2$ | $\rightarrow O + O + He$ |
| $He^* + O$ | $\rightarrow He + O^+ + e$ |
| $O^+ + e$ | $\rightarrow O^*$ |
| $O^*$ | $\rightarrow O + h\gamma$ (desired radiation) |

HYDROGEN RESONANCE LAMPS

In a hydrogen resonance lamp, only one arm is needed if a mixture of Ur and $UrH_3$ is used. The application of heat releases $H_2$ which is added to the high concentration of He*. The result produces a resonant atomic hydrogen emission.

In this application, uranium is used both as a source of hydrogen and as a getter whereas, in the oxygen lamp, heat is not applied to the getter (which is largely in the form of Ur) and the hydrogen is not released.

In both cases, the uranium acts as a getter for other gases (except rare gases) which are released from the wall during use. It is formed in a powder by reacting the uranium at high temperature with hydrogen to form uranium hydride and then decomposing this compound in vacuum, and pumping out the gas. For the hydrogen resonance lamp, a small fraction is left undecomposed so that it will become a source of $H_2$ after the getter is heated. The reactions occuring in the $H_2$ lamp are similar to those occuring in the oxygen lamp. $H_2$ and H replace $O_2$ and O.

If the He filling in the oxygen lamp is replaced by $N_2$, the lamp is a good source of the NO gamma bands which are suitable for measuring NO. In this application, $N_2$ is slightly decomposed producing $N(^2D)$ which rapidly reacts with $O_2$ to produce NO which is excited by energy transfer from $N_2$ ($A^3\ ^3E_u^t$) produced as a consequence of direct electron excitation and as a final step in triplet level cascades.

These lamps operate with relatively low power (28 volts, 0.5 amps).

Although the lamp is shown as cylindrical, this particular geometrical configuration is not essential so long as the reentrant portion with the electrode extends coaxially substantially the length of the tube. Further, the lamp body can be of any sufficiently strong, nonporous material such as the illustrated glass or a suitable metal.

Figure 2:
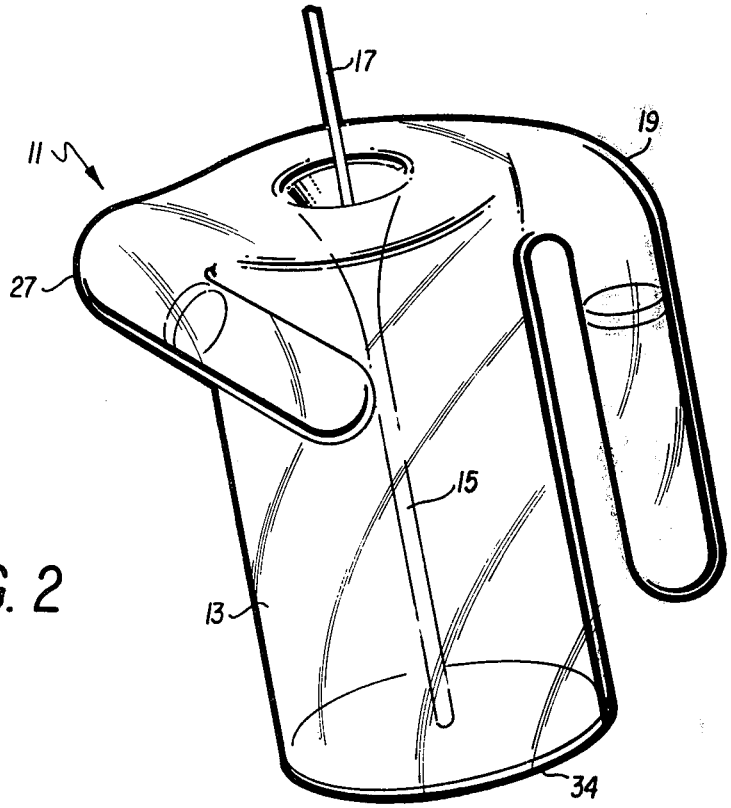
FIG. 2 is a perspective view of a preferred embodiment of the present invention.

FIG. 3 shows a modified version of the device illustrated in FIGS. 1 and 2. A cylindrical body 41 has extending therefrom arms 43 and 45 in the same manner as shown in FIG. 1. Additionally electrode 47 extends downwardly into a coaxial reentrant portion of the tube. The main body of the tube is surrounded by an electrically conductive sheathing 49.

In this embodiment the RF excited energy is provided by a series tuned circuit which includes RF generator 51 and the necessary ground connection as shown.

FIG. 4 is identical to the structure of FIG. 3 with the exception that the cylindrical body 61 has the electrically conductive sheathing 63 mounted within the body and being provided with the necessary electrical connection through a glass seal 65.

Figure 5:
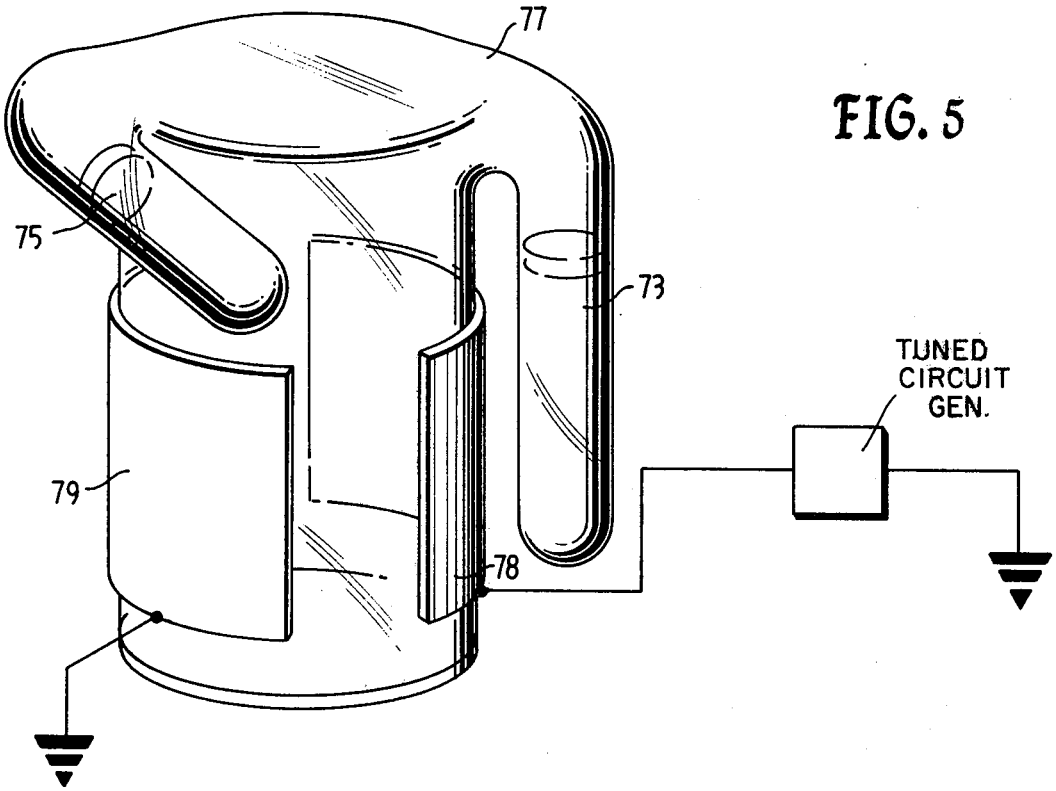
FIGS. 5 and 6 are perspective views of alternative tube structures using a different electrode structure.

FIG. 5 shows a further embodiment of the invention as described above. There is shown therein a cylindrical body having integral arms 73 and 75. However, in this embodiment, the top of the body 77 is closed and has no reentrant portion.

The discharge occurs between two arcuate plates 78 and 79 secured to the outer surface of the body. Each of the plates is approximately 90° of the circumference of the body 71.

When the plates are excited by means of the series tuned circuit the discharge will occur in the manner described above.

Figure 6:
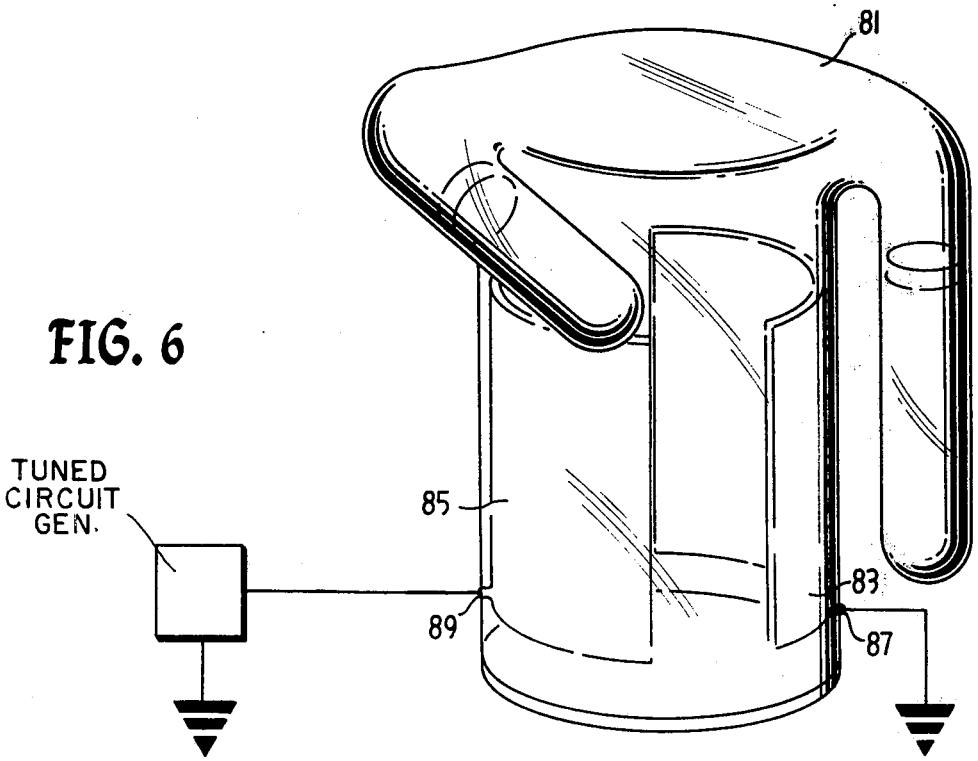

FIG. 6 is an embodiment similar to that shown in FIG. 5 except that cylinder 81 has the two arcuate plates 83 and 85 secured within body 81 with the necessary electrical connections being provided through glass seals 87 and 89.

As stated, body configuration and specific components may be replaced by equivalent structure without departing from the inenvtion. Accordingly, the above description and drawings are to be considered illustrative only, and the invention is to be limited only by the scope of the following claims.

I claim:

1. A resonance lamp comprising a dielectric closed body having a predetermined vacuum therein;

a reentrant coaxial hollow glass element integral within said body and extending from one end thereof substantially the length of said body;

an electrical conductor within said element;

an ultraviolet transparent window at the other end of said body;

two hollow arms integral with and extending from said body;

a high purity rare gas filling within said body at a pressure of 1 to 2 torr;

a source of diatomic gas in one of said arms;

an electrically conductive sheathing adjacent said glass body;

a getter in the other said arm for removing gases from said body;

means for separately heating each of said arms; and a series tuned circuit connected between said electrical conductor and said electrically conductive sheathing for providing RF excitation of said lamp.

2. The lamp of claim 1 wherein said sheathing is adjacent to the exterior of said glass body.

3. The lamp of claim 1 wherein said sheathing is adjacent to the interior of said glass body.

4. A resonance lamp comprising a dielectric closed body having a predetermined vacuum therein;

an ultraviolet transparent window at one end of said body;

two hollow arms integral with and extending from said body;

a high purity rare gas filling within said body at a pressure of 1 to 2 torr;

a source of diatomic gas in one of said arms;

two separate conductive sheathings adjacent said glass body;

a getter in the other said arm for removing gases from said body; and means for separately heating each of said arms.

5. The resonance lamp of claim 4 further comprising a series tuned circuit connected between said sheathings for providing RF excitation of said lamp.

6. The resonance lamp of claim 4 wherein said conductive sheathings are adjacent the exterior of said lamp.

7. The resonance lamp of claim 4 wherein said conductive sheathings are adjacent to the interior of said lamp.

* * * * *